US010399336B2

(12) United States Patent
Katakura et al.

(10) Patent No.: US 10,399,336 B2
(45) Date of Patent: Sep. 3, 2019

(54) LIQUID EJECTING APPARATUS HAVING OUTFLOW PASSAGE RESISTANCE CHANGING MEMBER AND LIQUID EJECTION METHOD THEREOF

(71) Applicant: Seiko Epson Corporation, Tokyo (JP)

(72) Inventors: Takahiro Katakura, Okaya (JP); Keigo Sugai, Chino (JP); Hirofumi Sakai, Shiojiri (JP); Shinichi Nakamura, Okaya (JP); Junichi Sano, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/919,378

(22) Filed: Mar. 13, 2018

(65) Prior Publication Data

US 2018/0281411 A1 Oct. 4, 2018

(30) Foreign Application Priority Data

Mar. 28, 2017 (JP) ..... 2017-062683

(51) Int. Cl.
*B41J 2/14* (2006.01)
*B41J 2/18* (2006.01)
(Continued)

(52) U.S. Cl.
CPC ..... *B41J 2/14274* (2013.01); *B41J 2/14072* (2013.01); *B41J 2/1626* (2013.01);
(Continued)

(58) Field of Classification Search
CPC .. B41J 2/14274; B41J 2/17593; B41J 2/1626; B41J 2/14072; B41J 2202/12; B41J 2002/14306
See application file for complete search history.

(56) References Cited

U.S. PATENT DOCUMENTS

2008/0018715 A1 1/2008 Wee et al.
2009/0102879 A1 4/2009 Katada et al.
(Continued)

FOREIGN PATENT DOCUMENTS

CN 101412322 A 4/2009
EP 1 862 311 A1 12/2007
(Continued)

OTHER PUBLICATIONS

Extended European Search Report for Application No. EP 18 16 1818 dated Jul. 25, 2018 (9 pages).

*Primary Examiner* — Henok D Legesse
(74) *Attorney, Agent, or Firm* — Harness, Dickey & Pierce, P.L.C.

(57) ABSTRACT

A liquid ejecting apparatus includes a liquid chamber in communication with a nozzle, a volume changing unit configured to change a volume of the liquid chamber, an inflow passage through which the liquid flows into the liquid chamber, an outflow passage through which the liquid flows out of the liquid chamber, a passage resistance changing unit configured to change a passage resistance of the outflow passage, and a controller configured to control the volume changing unit to reduce the volume of the liquid chamber so as to cause the liquid to be ejected through the nozzle. In filling the liquid chamber with the liquid for ejection of the liquid through the nozzle, the controller controls the passage resistance changing unit to change the passage resistance of the outflow passage to an increased passage resistance and controls the volume changing unit to increase the volume of the liquid chamber.

3 Claims, 7 Drawing Sheets

(51) Int. Cl.
*B41J 2/16* (2006.01)
*B41J 2/175* (2006.01)

(52) U.S. Cl.
CPC ..... *B41J 2/17593* (2013.01); *B41J 2/18* (2013.01); *B41J 2002/14306* (2013.01); *B41J 2202/05* (2013.01); *B41J 2202/12* (2013.01)

(56) References Cited

U.S. PATENT DOCUMENTS

| | | | | |
|---|---|---|---|---|
| 2011/0169897 | A1 | 7/2011 | Yokoyama et al. | |
| 2011/0228012 | A1* | 9/2011 | Yoshida | B41J 2/14274 347/68 |
| 2014/0078224 | A1* | 3/2014 | Park | B41J 2/14233 347/71 |

FOREIGN PATENT DOCUMENTS

| | | | |
|---|---|---|---|
| EP | 2 050 572 | A2 | 4/2009 |
| JP | 2011-213094 | A | 10/2011 |
| WO | WO-2013-032471 | A1 | 3/2013 |

* cited by examiner

<COMPARATIVE EXAMPLE>

LIQUID EJECTING APPARATUS HAVING OUTFLOW PASSAGE RESISTANCE CHANGING MEMBER AND LIQUID EJECTION METHOD THEREOF

BACKGROUND

1. Technical Field

The present invention relates to a liquid ejecting apparatus and a liquid ejection method.

2. Related Art

For example, JP-A-2011-213094 describes a circulating ink jet apparatus. In the circulating ink jet apparatus, a passage resistance of an ink outlet channel in communication with an ink chamber is increased in ejecting ink so that driving force of an actuator for ejection of the ink in the ink chamber is suppressed from escaping into the ink outlet channel.

However, according to the technique described in JP-A-2011-213094, when the passage resistance of the ink outlet channel is increased, the ink may flow back from the ink outlet channel to the ink chamber as the volume of the ink outlet channel decreases, which may lead to leakage of the ink through a nozzle in communication with the ink chamber. Thus, there is a demand for a technique for enabling a reduction in leakage of unnecessary ink through a nozzle. Such a problem is found not only in the circulating ink jet apparatus configured to eject ink but is a problem that is common to liquid ejecting apparatuses capable of ejecting liquid.

SUMMARY

An advantage of some aspects of the invention is that at least some of the above problems can be solved, and the invention can be implemented as the following aspect.

According to an aspect of the invention, a liquid ejecting apparatus is provided. The liquid ejecting apparatus includes: a liquid chamber in communication with a nozzle through which liquid is to be ejected; a volume changing unit configured to change a volume of the liquid chamber; an inflow passage which is connected to the liquid chamber and through which the liquid flows into the liquid chamber; an outflow passage which is connected to the liquid chamber and through which the liquid flows out of the liquid chamber; a liquid supplying unit configured to supply the liquid to the inflow passage; a passage resistance changing unit configured to change a passage resistance of the outflow passage; and a controller configured to control the volume changing unit to reduce the volume of the liquid chamber so as to cause the liquid to be ejected through the nozzle. In filling the liquid chamber with the liquid for ejection of the liquid through the nozzle, the controller performs first control of controlling the passage resistance changing unit to change the passage resistance of the outflow passage to an increased passage resistance and controlling the volume changing unit to increase the volume of the liquid chamber.

In the liquid ejecting apparatus according to the aspect, increasing the passage resistance of the outflow passage may cause liquid in the outflow passage to flow back to the liquid chamber, but because the volume of the liquid chamber is increased, the ink which flows back can be suppressed from leaking through the nozzle. Thus, it is possible to reduce leakage of unnecessary liquid through the nozzle.

In the liquid ejecting apparatus, after the liquid is ejected through the nozzle, the controller preferably performs second control of controlling the volume changing unit to increase the volume of the liquid chamber with the passage resistance changing unit being controlled to retain the increased passage resistance of the outflow passage. With this configuration of the liquid ejecting apparatus, it is possible to appropriately cut a tail of liquid and is thus possible to reduce excessive ejection of the liquid.

In the liquid ejecting apparatus, after performing the second control, the controller may perform third control of controlling the passage resistance changing unit to reduce the passage resistance of the outflow passage and controlling the volume changing unit to reduce the volume of the liquid chamber. With this configuration of the liquid ejecting apparatus, it is possible to suppress an excessive reduction of the pressure in the liquid chamber caused by reducing the passage resistance of the outflow passage after ejection of the liquid. Thus, it is possible to reduce liquid excessively drawn into the nozzle after the ejection of the liquid, thereby reducing air unnecessarily taken into the liquid chamber.

In the liquid ejecting apparatus, the volume changing unit preferably includes a first volume changing unit and a second volume changing unit, wherein the controller may be configured to perform control of causing the liquid to be ejected through the nozzle by using the first volume changing unit and to perform control of changing the volume of the liquid chamber by using the second volume changing unit. With this configuration of the liquid ejecting apparatus, the volume of the liquid chamber can be changed by the second volume changing unit. Thus, it is possible to reduce the size of the first volume changing unit and/or to increase the density of nozzles.

The liquid ejecting apparatus may further include a liquid reservoir connected to the outflow passage and configured to accumulate the liquid discharged from the outflow passage, wherein the liquid supplying unit may be a negative-pressure source connected to the liquid reservoir. With this configuration of the liquid ejecting apparatus, liquid can be supplied to the liquid chamber by negative pressure generated by the negative-pressure source.

The invention can be realized in various forms other than the above-described liquid ejecting apparatus. The invention can be realized, for example, in a liquid ejection method executed by a liquid ejecting apparatus, a computer program for controlling the liquid ejecting apparatus, and a non-transitory, tangible recording medium storing the computer program.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
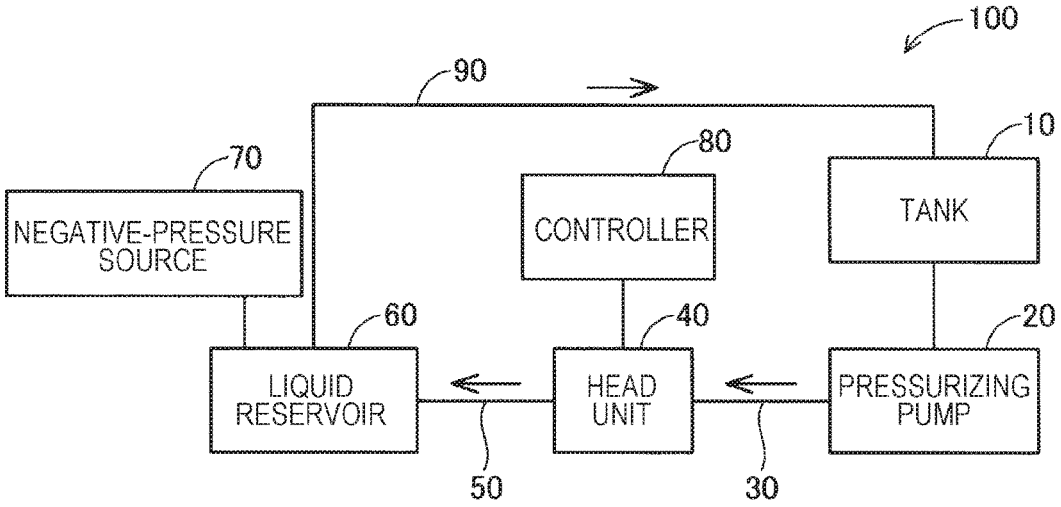
FIG. 1 is a view schematically illustrating the configuration of a liquid ejecting apparatus of a first embodiment.

FIG. 1 is a view schematically illustrating the configuration of a liquid ejecting apparatus 100 of a first embodiment of the invention. The liquid ejecting apparatus 100 includes a tank 10, a pressurizing pump 20, an inflow passage 30, a head unit 40, an outflow passage 50, a liquid reservoir 60, a negative-pressure source 70, and a controller 80.

The tank 10 contains liquid. Examples of the liquid include ink having a prescribed viscosity. The liquid in the tank 10 is supplied to the head unit 40 through the inflow passage 30 by the pressurizing pump 20. The liquid supplied to the head unit 40 is ejected by the head unit 40. Operation of the head unit 40 is controlled by the controller 80.

A portion of the liquid which is not ejected by the head unit 40 is discharged into the liquid reservoir 60 through the outflow passage 50. The negative-pressure source 70 which may include various pumps is connected to the liquid reservoir 60. The negative-pressure source 70 achieves negative pressure in the liquid reservoir 60, thereby sucking the liquid from the head unit 40 through the outflow passage 50. The pressurizing pump 20 and the negative-pressure source 70 cause differential pressure between the inflow passage 30 and the outflow passage 50 to function as a liquid supplying unit which supplies the liquid to the inflow passage 30. Note that one of the pressurizing pump 20 and the negative-pressure source 70 may be omitted, and the liquid supplying unit may include only the pressurizing pump 20 or only the negative-pressure source 70. As described above, in the present embodiment, the portion of the liquid which is not ejected from the head unit 40 is discharged from the head unit 40 into the outflow passage 50. Thus, it is possible to reduce accumulation of sedimentation components of the liquid in the head unit 40.

In the present embodiment, the liquid reservoir 60 is connected to the tank 10 by a circulation passage 90. The liquid reserved in the liquid reservoir 60 is returned to the tank 10 through the circulation passage 90 and is supplied to the head unit 40 again by the pressurizing pump 20. The circulation passage 90 may be provided with a pump for sucking the liquid from the liquid reservoir 60. Note that the circulation passage 90 may be omitted, and the liquid ejecting apparatus 100 may have a configuration in which the liquid is not circulated.

Figure 2:
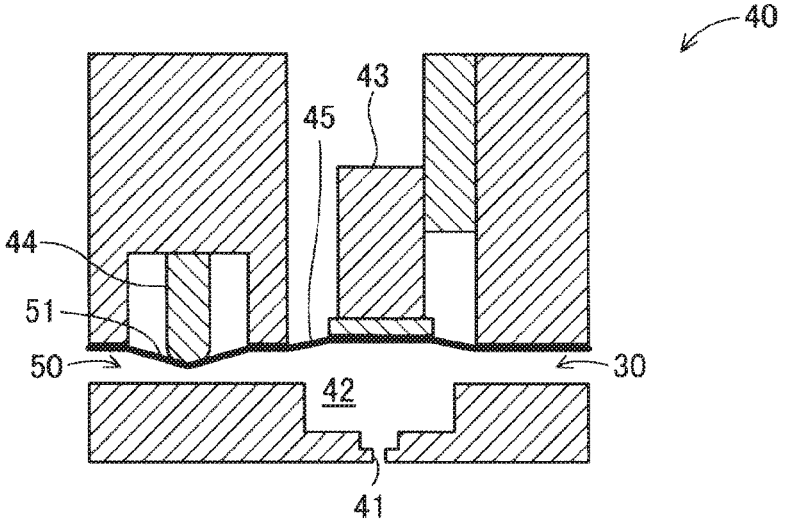
FIG. 2 is a view schematically illustrating the configuration of a head unit.

FIG. 2 is a view schematically illustrating the configuration of the head unit 40. The lower side in FIG. 2 corresponds to a downward direction of the gravity. The head unit 40 includes a nozzle 41, a liquid chamber 42, a volume changing unit 43, and a passage resistance changing unit 44. The liquid chamber 42 is a chamber to which the liquid is supplied. The liquid chamber 42 is in communication with the nozzle 41 through which the liquid is ejected to the outside. The inflow passage 30 through which the liquid flows into the liquid chamber 42 and the outflow passage 50 through which the liquid flows out of the liquid chamber 42 are connected to the liquid chamber 42. The liquid chamber 42 and the nozzle 41 are, for example, spaces formed in a metal material.

The liquid chamber 42 has a top surface 45 including an elastically deformable member such as a diaphragm or elastic lubber. The top surface 45 has an upper part provided with the volume changing unit 43 configured to change the volume of the liquid chamber 42. The volume changing unit 43 moves the top surface 45 in the up-down direction, which enables the volume of the liquid chamber 42 to be changed. In the present embodiment, a piezo actuator extendable in the up-down direction is used as the volume changing unit 43.

In the present embodiment, the outflow passage 50 has a top surface 51 a part of which includes an elastically deformable member such as a diaphragm or elastic lubber. The top surface 51 has an upper part provided with the passage resistance changing unit 44 configured to change the passage resistance of the liquid chamber 50. The passage resistance changing unit 44 moves the top surface 51 in the up-down direction, which enables the flow passage sectional area of the outflow passage 50 to be changed. In the present embodiment, a piezo actuator extendable in the up-down direction is used as the flow passage resistance changing unit 44.

The volume changing unit 43 and the passage resistance changing unit 44 are connected to the controller (FIG. 1). The controller 80 controls, for example, the volume changing unit 43 to reduce the volume of the liquid chamber 42 to cause the liquid to be ejected through the nozzle 41. For example, in filling the liquid chamber 42 with the liquid for ejection of the liquid through the nozzle 41, the controller 80 controls the passage resistance changing unit 44 to increase the passage resistance of the outflow passage 50 and controls the volume changing unit 43 to increase the volume of the liquid chamber 42. The controller 80 is configured as a computer including a CPU and memory and executes a control program stored in the memory to realize the processes. Note that the control program may be stored in a non-transitory, tangible various recording medium.

Figure 3:
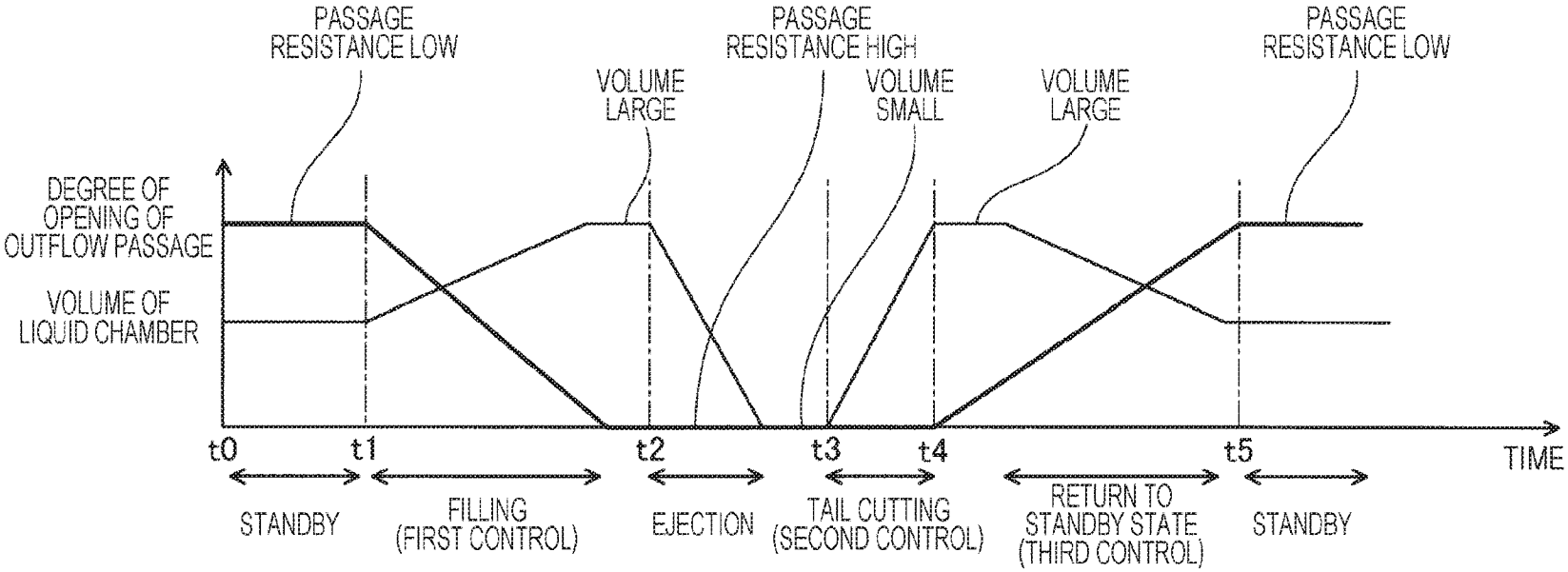
FIG. 3 is a timing diagram illustrating process contents of a liquid ejection method.

FIG. 3 is a timing diagram illustrating process contents of a liquid ejection method executed by the controller 80. In FIG. 3, the abscissa denotes a lapse of time, and the ordinate denotes the volume of the liquid chamber 42 and the degree of opening of the outflow passage 50. A high degree of opening of the outflow passage 50 means that the passage resistance of the outflow passage 50 is low. A low degree of opening of the outflow passage 50 means that the passage resistance of the outflow passage 50 is high. In the following description, the controller 80 controls the volume changing unit 43 to change the volume of the liquid chamber 42 and controls the passage resistance changing unit 44 to change the passage resistance of the outflow passage 50.

First, during a period from the time point t0 to the time point t1 shown in FIG. 3, the controller 80 is in a standby state with the volume of the liquid chamber 42 being a prescribed intermediate volume between a minimum volume and a maximum volume and the passage resistance of the outflow passage 50 being minimum. In the standby state, since the passage resistance of the outflow passage 50 is low, the liquid flowing from the inflow passage 30 into the liquid chamber 42 is not ejected from the nozzle 41 but flows out as it is to the outflow passage 50. Note that the applied pressure by the pressurizing pump 20, the negative pressure by the negative-pressure source 70, a minimum value of the passage resistance of the outflow passage 50, and the passage resistance of the inflow passage 30 are set such that in the standby state, the pressure in the liquid chamber 42 has a smaller value than the withstand pressure of a meniscus formed at an outlet of the nozzle 41. The withstand pressure Pm of the meniscus can be expressed by the following formula (1).

$$Pm=2\gamma \cos \theta/r \quad (1)$$

where γ is the liquid surface tension, θ is the contact angle of liquid with the nozzle 41, and r is a radius of the nozzle 41.

In the present embodiment, the minimum volume denotes a minimum volume that is adjustable by the volume changing unit 43, and the maximum volume denotes a maximum volume that is adjustable by the volume changing unit 43. Moreover, the passage resistance being maximum denotes a maximum passage resistance of the outflow passage 50 that is adjustable by the passage resistance changing unit 44, and the passage resistance being minimum denotes a minimum passage resistance of the outflow passage 50 that is adjustable by the passage resistance changing unit 44. In the case of the maximum passage resistance, in the present embodiment, the outflow passage 50 is in a closed state.

After the standby, the controller 80 performs first control of increasing the passage resistance of the outflow passage 50 and increasing the volume of the liquid chamber across the time point t1 and the time point t2. More specifically, the controller 80 increases the passage resistance of the outflow passage 50 from the minimum resistance to the maximum resistance and increases the volume of the liquid chamber 42 from the intermediate volume to the maximum volume. The first control fills the liquid chamber 42 and the nozzle 41 with liquid to be ejected.

After the liquid chamber 42 and the nozzle 41 are filled with the liquid by the first control, the controller 80 rapidly reduces the volume of the liquid chamber 42 to its minimum with the passage resistance of the outflow passage 50 being kept maximum during a period from the time point t2 to the time point t3. This causes the liquid to be ejected through the nozzle 41 in communication with the liquid chamber 42. Note that the passage resistance of the inflow passage 30 is set to an appropriate resistance value in advance so that a rapid reduction of the volume of the liquid chamber 42 can ensure pressure (pressure exceeding the withstand pressure of the meniscus) required for ejection of the liquid.

After the liquid is ejected through the nozzle 41, the controller 80 performs second control of increasing the passage volume of the liquid chamber 42 with the passage resistance of the outflow passage 50 being kept high across the time point t3 and the time point t4. More specifically, the controller 80 rapidly increases the volume of the liquid chamber 42 from the minimum volume to the maximum volume with the passage resistance of the flow passage 50 being kept maximum. By the second control, the tail of the ejected liquid is drawn into the nozzle 41 and is thereby cut, and the liquid is sputtered as liquid droplets.

After performing the second control, the controller 80 performs third control of reducing the passage resistance of the outflow passage 50 and reducing the volume of the liquid chamber 42 across the time point t4 and the time point t5. More specifically, the controller 80 reduces the passage resistance of the outflow passage 50 from the maximum resistance to the minimum resistance and reduces the volume of the liquid chamber 42 from the maximum volume to the intermediate volume. The third control returns the volume of the liquid chamber 42 and the passage resistance of the outflow passage 50 to those in the standby state. The controller 80 repeatedly performs the above-described process to enable continuous ejection of the liquid in liquid-droplet form through the nozzle 41.

Figure 4:
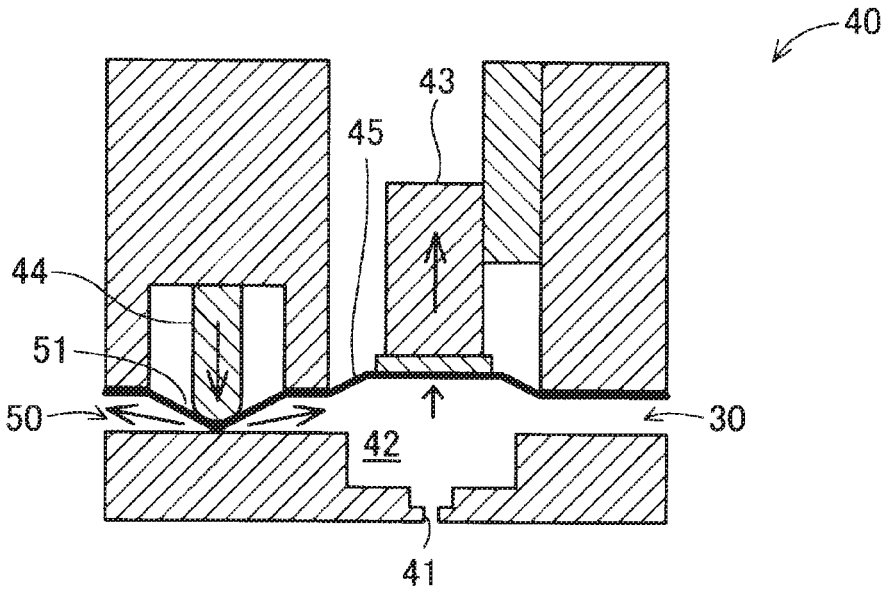
FIG. 4 is a view illustrating operation of the head unit.
Figure 5:
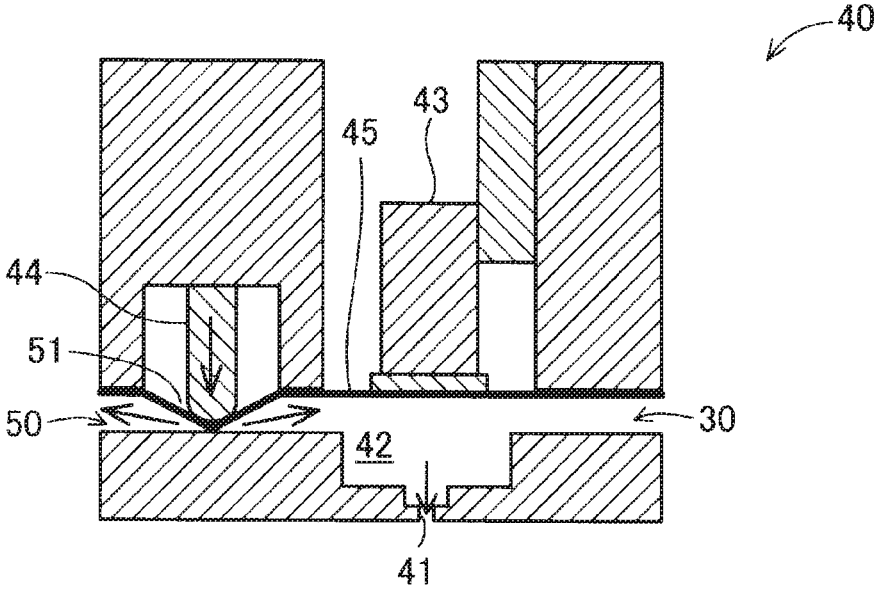
FIG. 5 is a view illustrating operation of a head unit of a comparative example.

FIG. 4 is a view illustrating operation of the head unit 40 of the present embodiment. FIG. 5 is a view illustrating operation of a head unit 40 of a comparative example. According to the liquid ejecting apparatus 100 of the present embodiment described above, the passage resistance changing unit 44 is controlled to increase the passage resistance of the outflow passage 50 in filling the liquid chamber 42 with the liquid by the above-described first control. Thus, it is possible to efficiently fill the liquid chamber 42 with the liquid while the liquid discharged from the outflow passage 50 is reduced.

Moreover, in the present embodiment, as illustrated in FIG. 4, the volume changing unit 43 is controlled to increase the volume of the liquid chamber 42 while the passage resistance changing unit 44 is controlled to increase the passage resistance of the outflow passage 50. Thus, even when pressing the top surface 51 of the outflow passage 50 by the passage resistance changing unit 44 (actuator) in order to increase the passage resistance of the outflow passage 50 causes liquid directly under the top surface 51 to flow back to the liquid chamber 42, the liquid which flows back can be captured in the liquid chamber 42 having an increased volume. Thus, leakage of the liquid flowing back from the outflow passage 50 through the nozzle 41 as illustrated in the comparative example of FIG. 5 can be reduced. Thus, it is possible to reduce leakage of unnecessary ink through the nozzle 41. Note that in the above-described first control, the volume of the liquid chamber 42 preferably reaches its maximum before the passage resistance of the outflow passage 50 reaches its maximum. In this way, the liquid which flows back from the outflow passage 50 can be more appropriately captured in the liquid chamber 42.

Moreover, in the present embodiment, the liquid is filled by the first control, and then, the liquid is ejected through the nozzle 41 with the passage resistance of the outflow passage 50 being kept high. Thus, it is possible to suppress pressure for ejecting liquid from escaping into the outflow passage 50. Thus, it is possible to efficiently eject the liquid.

Moreover, in the present embodiment, the liquid is ejected through the nozzle 41, and then the second control is performed to control the volume changing unit 43 to rapidly increase the volume of the liquid chamber 42 with the passage resistance changing unit 44 being controlled such that the passage resistance of the outflow passage 50 is kept high. Thus, it is possible to reduce suction force escaping into the outflow passage 50. The tail of ejected liquid is sucked into the nozzle 41 by the suction force. Thus, it is possible to appropriately cut the tail of the liquid and to reduce excessive ejection of the liquid through the nozzle 41.

Moreover, in the present embodiment, after the liquid is ejected through the nozzle 41, the third control is performed to control the passage resistance changing unit 44 to reduce the passage resistance of the outflow passage 50 and to control the volume changing unit 43 to reduce the volume of the liquid chamber 42. Thus, it is possible to suppress an excessive reduction of the pressure in the liquid chamber 42 due to flow of the liquid from the liquid chamber 42 into the outflow passage 50. Thus, it is possible to reduce liquid excessively drawn into the nozzle after the ejection of the liquid. This reduces air unnecessarily taken into the liquid chamber 42. Thus, it is possible to reduce cases, for example, where ejection of the liquid is attempted but the liquid cannot be ejected because the pressure in the liquid chamber 42 is not sufficiently increased due to air (bubbles) remaining in the liquid chamber 42. Note that in the above-described third control, control of reducing the volume of the liquid chamber 42 is preferably started after control of reducing the flow passage resistance of the outflow passage 50 is started. This reduces liquid which flows toward the nozzle 41 along with a reduction of the volume of the liquid chamber 42.

Second Embodiment

Figure 6:
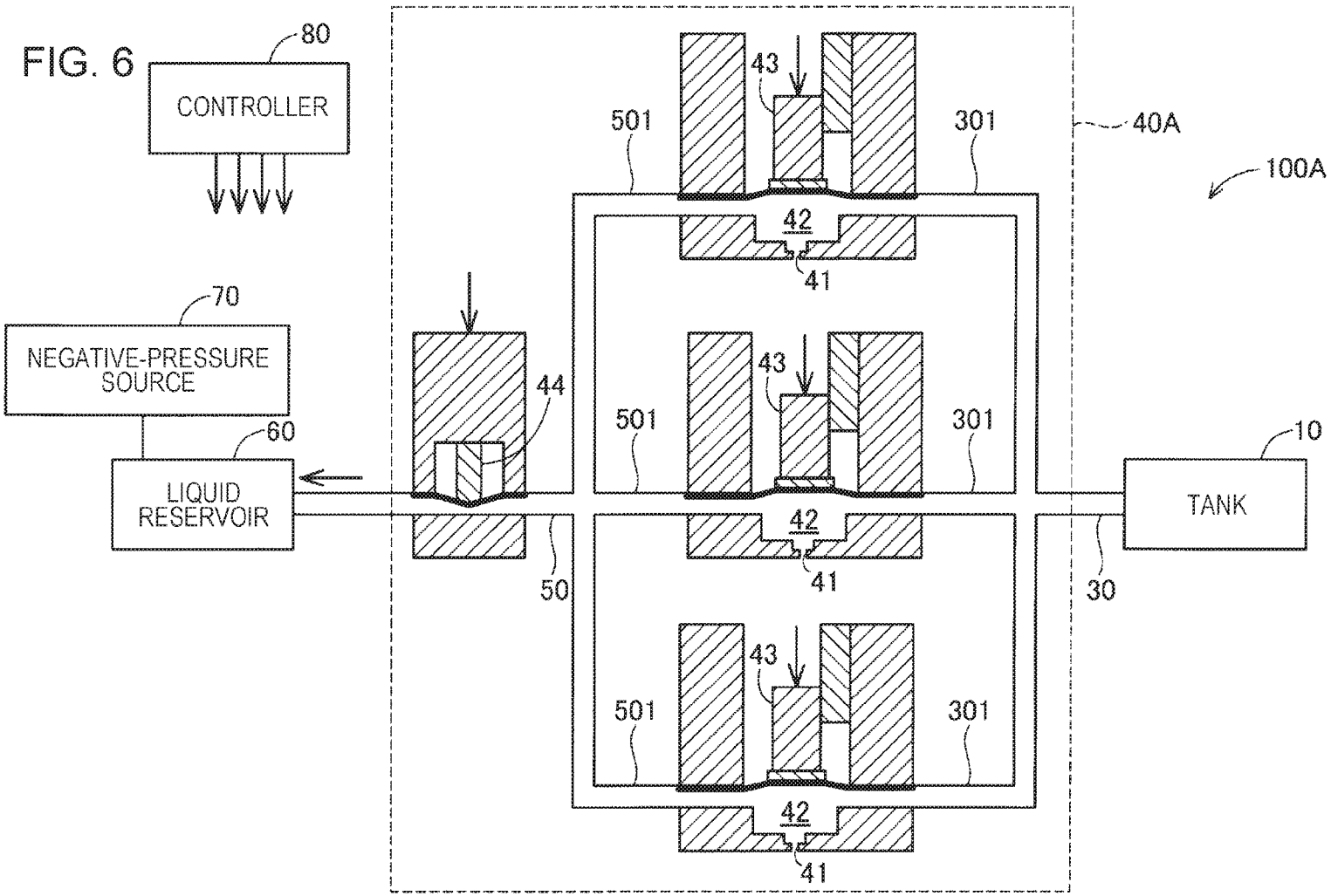
FIG. 6 is a view schematically illustrating the configuration of a liquid ejecting apparatus of a second embodiment.

FIG. 6 is a view schematically illustrating the configuration of a liquid ejecting apparatus 100A of a second embodiment of the invention. The liquid ejecting apparatus 100A of the present embodiment includes a head unit 40A including a plurality of liquid chambers 42, nozzles 41, and volume changing units 43. In the following description, a set of liquid chamber 42, nozzle 41, and volume changing unit 43 is referred to "head". That is, in the present embodiment, the head unit 40A includes a plurality of heads.

The liquid chambers 42 of the heads are connected to respective branch inflow passages 301 branching from one inflow passage 30. Moreover, the liquid chambers 42 of the heads are connected to respective branch outflow passages 501 which join with each other to form one outflow passage 50 provided with one passage resistance changing unit 44. That is, in the present embodiment, one passage resistance changing unit 44 is commonly used by the plurality of heads. A controller 80 is connected to the passage resistance changing unit 44 and the volume changing unit 43 of each head to control operation of these units. Note that the liquid ejecting apparatus 100A of the present embodiment includes neither the pressurizing pump 20 (see FIG. 1) nor the circulation passage 90 (see FIG. 1). Thus, liquid is supplied from a tank 10 to the liquid chamber 42 of each head by negative pressure generated by a negative-pressure source 70.

Figure 7:
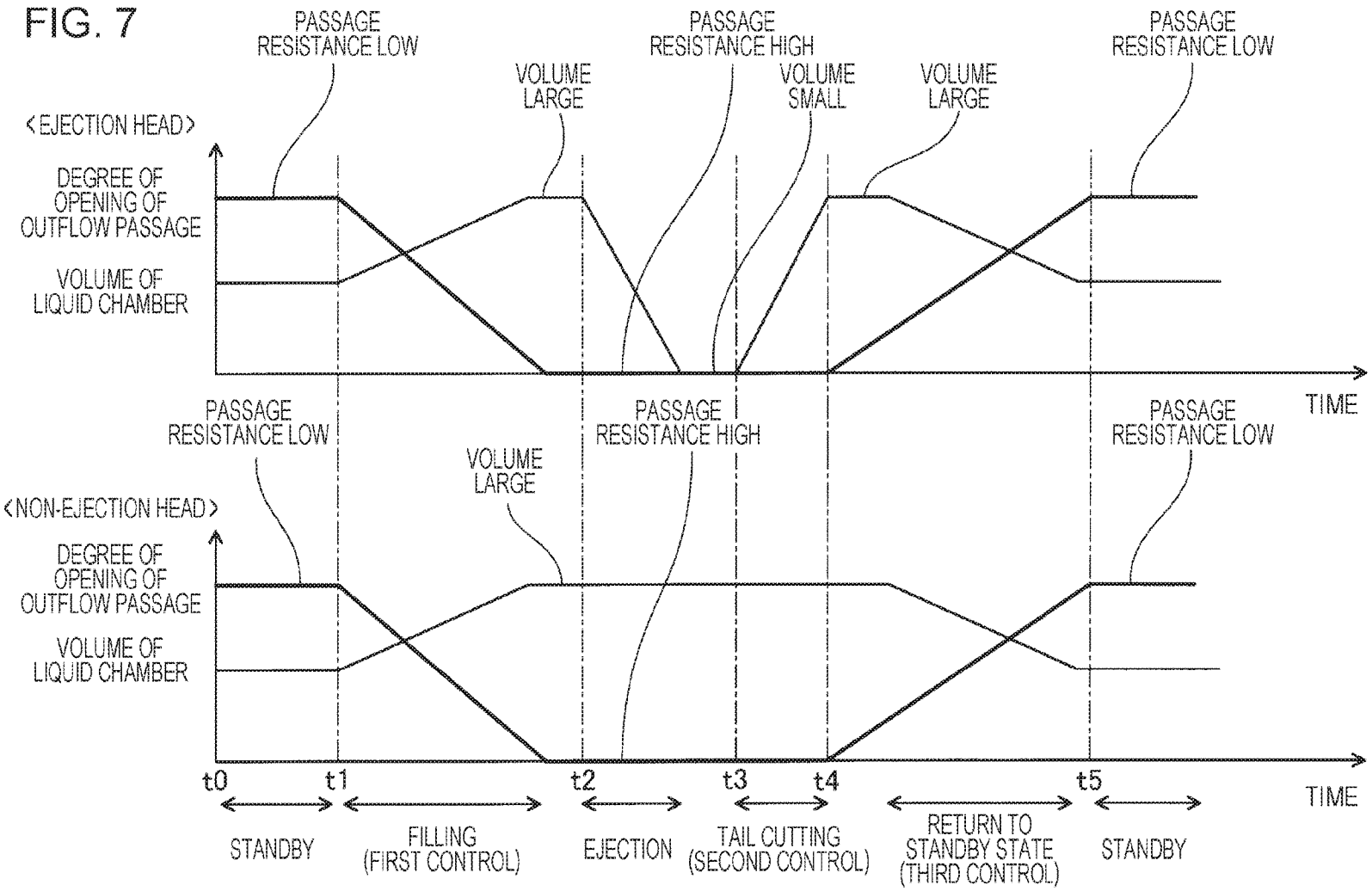
FIG. 7 is a timing diagram illustrating process contents of a liquid ejection method.

FIG. 7 is a timing diagram illustrating process contents of a liquid ejection method executed by the controller 80. In FIG. 7, a timing diagram of a head (ejection head) which ejects liquid is shown in the upper part, and a timing diagram of a head (non-ejection head) which ejects no liquid is shown in the lower part. In the present embodiment, the heads eject the liquid at a synchronous timing, wherein the liquid is ejected from only one or more heads specified by the controller 80.

In the present embodiment, the passage resistance changing unit 44 is commonly used by the heads. Thus, as illustrated in FIG. 7, the passage resistance of the outflow passage 50 is changed by the passage resistance changing unit 44 exactly in the same manner between the ejection head and the non-ejection head. In contrast, a change of the volume of the liquid chamber 42 of the ejection head by the volume changing unit 43 is different from a change of the volume of the liquid chamber 42 of the non-ejection head by the volume changing unit 43. That is, for the ejection head, as shown in the upper part of the figure, in order to eject liquid from the liquid chamber 42, the volume of the liquid chamber 42 changes from the maximum volume to the minimum volume across the time point t2 and the time point t3 and changes from the minimum volume to the maximum volume across the time point t3 and the time point t4. This is the same as the control contents shown in first embodiment (FIG. 3). In contrast, for the non-ejection head, as shown in the lower part of the figure, the volume of the liquid chamber is kept maximum across the time point t2 and the time point t4. As described above, when the volume of the liquid chamber 42 is not changed and is kept maximum, the liquid is not ejected from the non-ejection head.

Note that in the present embodiment, also for the non-ejection head, the passage resistance of the outflow passage 50 is increased and the volume of the liquid chamber is increased by the first control during a period from the time point t1 to the time point t2. In this way, the liquid chamber 42 having an increased volume in each head can capture liquid flowing back from the outflow passage 50 when the passage resistance of the outflow passage 50 is increased. Thus, similarly to the first embodiment, the present embodiment can also reduce leakage of the liquid flowing back from the outflow passage 50 through the nozzle 41. Moreover, in the present embodiment, one passage resistance changing unit 44 is commonly used by the plurality of heads, and thus, the number of actuators can be reduced. Thus, it is possible to reduce the size of the head unit 40A including the plurality of heads and to increase the density of the nozzles 41.

Third Embodiment

Figure 8:
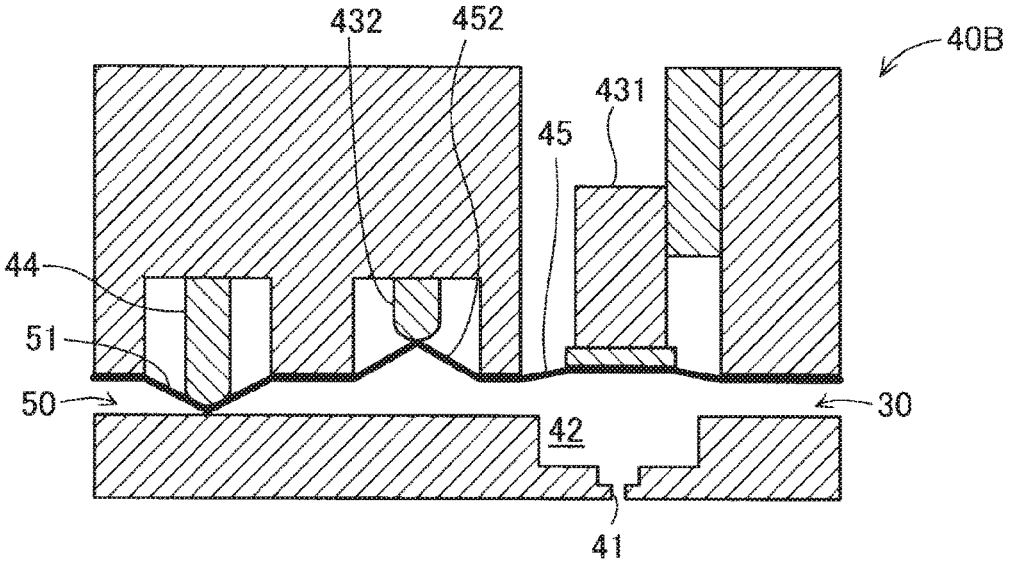
FIG. 8 is a view schematically illustrating the configuration of a head unit of a third embodiment.

FIG. 8 is a view schematically illustrating the configuration of a head unit 40B of a third embodiment of the invention. In the third embodiment, the general configuration of the liquid ejecting apparatus 100 is the same as that of the first embodiment, and the configuration of a head unit 40B is different from that of the first embodiment.

Similarly to the first embodiment, the head unit 40B in the present embodiment includes a nozzle 41, a liquid chamber 42, and a passage resistance changing unit 44. In the present embodiment, the head unit 40B further includes a first volume changing unit 431 and a second volume changing unit 432 as volume changing units. The configuration of the first volume changing unit 431 is the same as that of the volume changing unit 43 of the first embodiment. The second volume changing unit 432 is disposed between the first volume changing unit 431 and the passage resistance changing unit 44 and includes a piezo actuator configured to displace an elastically deformable one side surface 452 of the liquid chamber 42. A controller 80 is connected to the first volume changing unit 431, the second volume changing unit 432, and the passage resistance changing unit 44 to control operation of these units. In the first embodiment, the volume changing unit 43 has both a function of changing the volume of the liquid chamber 42 and a function of causing liquid to be ejected through the nozzle 41, whereas in the present embodiment, the first volume changing unit 431 mainly functions to cause the liquid to be ejected through the nozzle 41, and the second volume changing unit 432 mainly functions to change the volume of the liquid chamber 42. That is, in the present embodiment, the controller 80 performs control of causing liquid to be ejected through the nozzle 41 by using the first volume changing unit 431 and performs control of changing the volume of the liquid chamber 42 by using the second volume changing unit 432.

Figure 9:
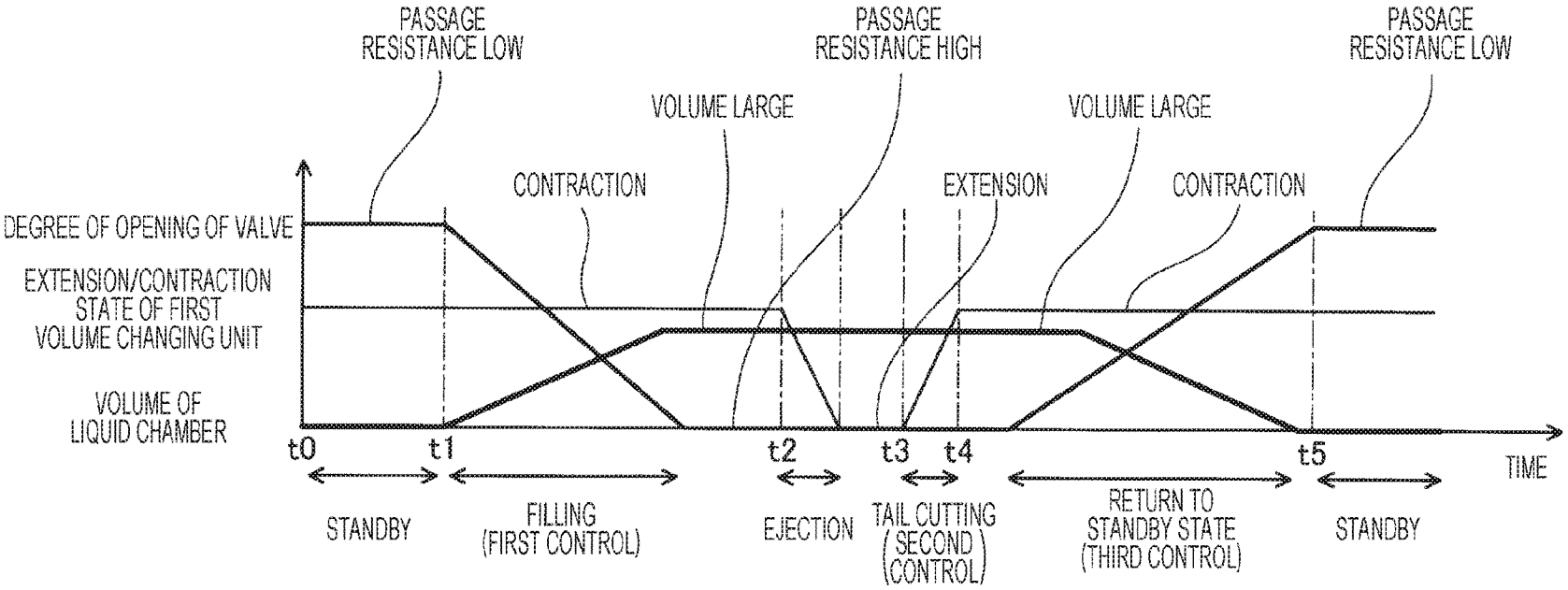
FIG. 9 is a timing diagram illustrating process contents of a liquid ejection method.

FIG. 9 is a timing diagram illustrating process contents of a liquid ejection method executed by the controller 80. FIG. 9 shows a change in the degree of opening of an outflow passage 50, an extension and contraction state of the first volume changing unit 431, and a change in the volume of the liquid chamber 42 changed by the second volume changing unit 432.

As illustrated in FIG. 9, the controller 80 of the present embodiment changes the degree of opening of the outflow passage 50, that is, the passage resistance of the outflow passage 50 by control similar to the control in the first embodiment. Meanwhile, from a time point t0 to a time point t2, that is, in a standby state and while the liquid chamber 42 is filled with liquid, the controller 80 controls such that the extension and contraction state of the first volume changing unit 431 is fixed, and the controller 80 extends the first volume changing unit 431 at the time point t2 at which the liquid is ejected, and after the liquid is ejected, the controller 80 contracts the second volume changing unit 432 at the time point t3 at which the tail of the liquid is cut. After the tail of the liquid is cut, and at and after the time point t4, the first volume changing unit 431 is in the contracted state again. Moreover, the controller 80 controls the second volume changing unit 432 such that the volume of the liquid chamber 42 is minimum in the standby state from the time point t0 to a time point t1 and the volume of the liquid chamber is increased to the maximum volume during a period from the time point t1 to the time point t2 during which the liquid chamber is filled with the liquid. Then, after the time point t4 at which ejection of liquid and cutting of the tail of the liquid are completed, the volume of the liquid chamber 42 is reduced to the minimum volume.

Note that in the present embodiment, reducing the volume of the liquid chamber 42 to the minimum volume means that the volume of the liquid chamber is changed to the minimum volume within a range adjustable by the second volume changing unit 432 without a change in the volume due to extension of the first volume changing unit 431 being taken into consideration. Similarly, increasing the volume of the liquid chamber 42 to the maximum volume means that the volume of the liquid chamber 42 is changed to the maximum volume within a range adjustable by the second volume changing unit 432 without a change in the volume due to extension of the first volume changing unit 431 being taken into consideration.

Also in the third embodiment, controlling the first volume changing unit 431 and the second volume changing unit 432 by the controller 80 individually enables operation similar to the operation of the volume changing unit 43 of the first embodiment. Thus, the third embodiment can also provide effects similar to those provided by the first embodiment. Moreover, according to the present embodiment, the second volume changing unit 432 enables the volume of the liquid chamber 42 to be changed. Thus, the first volume changing unit 431 is only required to be configured to enable liquid to be ejected through the nozzle 41. Therefore, it is possible to reduce the size of actuators included in the first volume changing unit 431 and to increase the density of the nozzles 41. Moreover, in the present embodiment, the second volume changing unit 432 is independent. Thus, increasing the movable range of the second volume changing unit 432 enables easily designing a structure which can withstand a large change in volume of the outflow passage 50 (i.e., an increase in back-flow rate of the liquid). Therefore, the variable range of the passage resistance of the outflow passage 50 can be increased.

Note that the head unit 40B in the third embodiment is not limited to the liquid ejecting apparatus 100 of the first embodiment but may be applicable to the liquid ejecting apparatus 100A of the second embodiment. When the head unit 40B of the third embodiment is applied to the liquid ejecting apparatus 100A of the second embodiment, only the passage resistance changing unit 44 may be commonly used by the plurality of heads, or the passage resistance changing unit 44 and the second volume changing unit 432 may be commonly used by the plurality of heads. When the passage resistance changing unit 44 and the second volume changing unit 432 are commonly used by the plurality of heads, the number of actuators can be reduced, and thus, it is possible to more easily reduce the size of the head unit and increase the density of the nozzles 41.

VARIATIONS

First Variation

In the above-described embodiments, the controller 80 performs the second control of increasing the volume of the liquid chamber 42 with the passage resistance of the outflow passage 50 being kept high to suck the tail of the liquid into the nozzle 41 and to cut the tail. In contrast, for example, a cutter for cutting the tail of the liquid may be disposed in the vicinity of the outlet of the nozzle 41, and the cutter may be driven in synchronization with an ejection timing of the liquid to cut the tail of the liquid.

Second Variation

In the above-described embodiment, the controller 80 performs, after the second control, the third control of reducing the passage resistance of the outflow passage 50 and reducing the volume of the liquid chamber 42, thereby reducing liquid being excessively drawn into the nozzle 41 after the liquid is ejected. In contrast, the controller 80 does not change the volume of the liquid chamber 42 in the third control, but, for example, the pressurizing pump 20 may apply pressure to the liquid in the liquid chamber 42, thereby reducing liquid being excessively drawn into the nozzle 41.

Third Variation

The above-described embodiments adopts piezo actuators as the volume changing unit 43 (first volume changing unit 431, second volume changing unit 432) and the passage resistance changing unit 44. However, these units are not limited to the piezo actuators but may be other actuators such as air cylinders, solenoids, and magnetostriction materials.

Fourth Variation

The invention is not limited to the liquid ejecting apparatus which ejects ink, but the invention is applicable to any liquid ejecting apparatus which eject liquid other than ink. For example, the invention is applicable to various liquid ejecting apparatuses as listed below.

(1) Image recording apparatuses such as facsimile apparatuses.

(2) Color material ejecting apparatuses used for producing color filters for image display apparatuses such as liquid crystal display units.

(3) Electrode material ejecting apparatuses used for forming electrodes of organic electro luminescence (EL) displays, field emission displays (FED), and the like.

(4) Liquid ejecting apparatuses which eject liquid containing bio-organic substances used for biochip production.

(5) Sample ejecting apparatuses as precision pipettes.

(6) Lubricating oil ejecting apparatuses.

(7) Resin solution ejecting apparatuses.

(8) Liquid ejecting apparatuses which eject lubricating oil onto precision machinery such as watches and cameras with pinpoint accuracy.

(9) Liquid ejecting apparatuses which eject, onto a substrate, a transparent resin solution such as a ultraviolet curing resin solution to form micro hemispherical lens (optical lens) and the like used for, for example, optical communication elements.

(10) Liquid ejecting apparatuses which eject an acidic or alkaline etching solution for etching, for example, substrates.

(11) Liquid ejecting apparatuses including liquid ejection heads from which a very small amount of any other liquid droplets are ejected.

Note that the term "liquid droplet" denotes a state of liquid ejected from the liquid ejecting apparatus and includes a granular droplet, tear-like droplet, and droplet having a filamentous tail. Moreover, the liquid mentioned herein can be any material as long as it can be taken up by the liquid ejecting apparatus. For example, the liquid is required only to be a material in a state of a substance in a liquid phase, and examples of the liquid include materials in liquid form having high or low viscosity and materials in liquid form such as sol, gel water, other inorganic solvents, organic solvents, solutions, liquid resins, and liquid metal (metal melt). Moreover, examples of the liquid include not only liquid as a state of a substance but also materials obtained by dissolving, dispersing, or mixing particles of functional materials made of solid bodies such as pigment and metal particles into solvents. Typical examples of the liquid include ink and liquid crystal. Here, ink includes various liquid compositions such as general water-based ink, oil-based ink, gel ink, and hot melt ink.

The invention is not limited to the embodiments or the variations described above but may be realized in various configurations without departing from scope of the technique. For example, technical features in the embodiments and the variations corresponding to technical features in each embodiment described in the summary of the invention may be changed or combined with each other accordingly in order to solve some or all of the above-described problems, or in order to achieve some or all of the above-described advantages. When the technical features are not described as essential feature in the present specification, the technical features may accordingly be deleted.

The entire disclosure of Japanese Patent Application No. 2017-062683, filed Mar. 28, 2017 is expressly incorporated by reference herein.

What is claimed is:

1. A liquid ejecting apparatus, comprising:

a liquid storage that is configured to store a liquid, a liquid chamber in which a nozzle is provided, the liquid chamber being fluidly connected to the nozzle through which the liquid is ejected, the liquid chamber having first, second, and third chamber states, the first chamber state corresponding to a normal chamber volume, the second chamber state corresponding to a larger chamber volume that is larger than the normal chamber volume, the third chamber state corresponding to a smaller chamber volume that is smaller than the normal chamber volume;

an inflow passage that is fluidly connected between the liquid storage and the liquid chamber so as to flow the liquid from the liquid storage to the liquid chamber;

a first actuator that is configured to change the states of the liquid chamber among the first, second, and third chamber states;

an outflow passage that is fluidly connected between the liquid chamber and the liquid storage so as to flow the liquid from the liquid chamber to the liquid storage, the outflow passage having first and second passage states, the first passage state having a larger passage volume than the second passage state;

a second actuator that is configured to change a passage resistance of the outflow passage; and a processor configured to execute computer-readable instructions stored in a memory so as to control the first actuator to cause the liquid to be ejected through the nozzle, the processor being configured to change the states of the first actuator among the first, second, and third chamber states, the processor being configured to change the states of the second actuator among the first and second passage states, wherein the processor is configured to place the second actuator in the first passage state while the first actuator is in the first chamber state, the processor is configured to place the second actuator in the second passage state and to place the first actuator in the second chamber state, the processor is configured to maintain the second actuator in the second passage state and to cause the first actuator to change from the second chamber state to the third chamber state so that the liquid is ejected from the nozzle, the processor is configured to maintain the second actuator in the second passage state and to cause the first actuator to change from the third chamber state to the second chamber state so that a rear end the ejected liquid is cut so as to form a liquid droplet, and the processor is configured to cause the second actuator to change from the second passage state to the first passage state and to cause the first actuator to change from the second chamber state to the first chamber state.

2. The liquid ejecting apparatus according to claim 1, further comprising:

a liquid reservoir that is fluidly connected to the outflow passage and configured to accumulate the liquid discharged from the outflow passage; and a negative-pressure source connected to the liquid reservoir, wherein the liquid reservoir is fluidly connected to the liquid storage, and the negative-pressure source is configured to supply the liquid from the liquid reservoir to the inflow passage through the liquid storage.

3. A liquid ejection method executed by a liquid ejecting apparatus, the liquid ejecting apparatus including:

a liquid storage that is configured to store a liquid;

a liquid chamber in which a nozzle is provided, the liquid chamber being fluidly connected to the nozzle through which the liquid is ejected, the liquid chamber having first, second, and third chamber states, the first chamber state corresponding to a normal chamber volume, the second chamber state corresponding to a larger chamber volume that is larger than the normal chamber volume, the third chamber state corresponding to a smaller chamber volume that is smaller than the normal chamber volume;

an inflow passage that is fluidly connected between the liquid storage and the liquid chamber so as to flow the liquid from the liquid storage to the liquid chamber;

a first actuator that is configured to change the states of the liquid chamber among the first, second, and third chamber states;

an outflow passage that is fluidly connected between the liquid chamber and the liquid storage so as to flow the liquid from the liquid chamber to the liquid storage, the outflow passage having first and second passage states, the first passage state having a larger passage volume than the second passage state;

a second actuator that is configured to change a passage resistance of the outflow passage; and a processor configured to execute computer-readable instructions stored in a memory so as to control the first actuator to cause the liquid to be ejected through the nozzle, the processor being configured to change the states of the first actuator among the first, second, and third chamber states, the processor being configured to change the states of the second actuator among the first and second passage states, the liquid ejection method comprising for causing the processor to execute a process, the method comprising executing on the processor the steps of:

placing the second actuator in the first passage state while the first actuator is in the first chamber state, placing the second actuator in the second passage state and placing the first actuator in the second chamber state, maintaining the second actuator in the second passage state and causing the first actuator to change from the second chamber state to the third chamber state so that the liquid is ejected from the nozzle, maintaining the second actuator in the second passage state and causing the first actuator to change from the third chamber state to the second chamber state so that a rear end the elected liquid is cut so as to form a liquid droplet, and causing the second actuator to change from the second passage state to the first passage state and causing the first actuator to change from the second chamber state to the first chamber state.

* * * * *